US008632419B2

(12) United States Patent
Tang et al.

(10) Patent No.: US 8,632,419 B2
(45) Date of Patent: Jan. 21, 2014

(54) GOLF CLUB HEAD

(75) Inventors: Larry G. Tang, Carlsbad, CA (US); J. Neil Hall, Carlsbad, CA (US); Sean Griffin, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 104 days.

(21) Appl. No.: 13/034,046

(22) Filed: Feb. 24, 2011

(65) Prior Publication Data

US 2011/0218053 A1 Sep. 8, 2011

Related U.S. Application Data

(60) Provisional application No. 61/311,114, filed on Mar. 5, 2010.

(51) Int. Cl.
*A63B 53/04* (2006.01)

(52) U.S. Cl.
USPC ..... 473/329; 473/342; 473/345

(58) Field of Classification Search
USPC ..... 473/324–350
See application file for complete search history.

(56) References Cited

U.S. PATENT DOCUMENTS

| | | | | |
|---|---|---|---|---|
| 1,705,997 | A * | 3/1929 | Quynn | 473/329 |
| 4,398,965 | A * | 8/1983 | Campau | 148/522 |
| 5,076,585 | A * | 12/1991 | Bouquet | 473/343 |
| 5,203,565 | A | 4/1993 | Murray et al. | |
| 5,437,456 | A * | 8/1995 | Schmidt et al. | 473/291 |
| 5,492,327 | A * | 2/1996 | Biafore, Jr. | 473/332 |
| 5,735,754 | A | 4/1998 | Antonious | |
| 5,830,084 | A | 11/1998 | Kosmatka | |
| 6,042,486 | A * | 3/2000 | Gallagher | 473/329 |
| 6,086,485 | A * | 7/2000 | Hamada et al. | 473/329 |
| 6,244,976 | B1 | 6/2001 | Murphy et al. | |
| 6,332,847 | B2 | 12/2001 | Murphy et al. | |
| 6,348,013 | B1 * | 2/2002 | Kosmatka | 473/329 |
| 6,354,962 | B1 | 3/2002 | Galloway et al. | |
| 6,368,234 | B1 | 4/2002 | Galloway | |
| 6,386,990 | B1 | 5/2002 | Reyes et al. | |
| 6,398,666 | B1 | 6/2002 | Evans et al. | |
| 6,406,378 | B1 | 6/2002 | Murphy et al. | |
| 6,435,977 | B1 | 8/2002 | Helmstetter et al. | |
| 6,440,008 | B2 | 8/2002 | Murphy et al. | |
| 6,471,604 | B2 | 10/2002 | Hocknell et al. | |
| 6,478,692 | B2 | 11/2002 | Kosmatka | |
| 6,482,106 | B2 | 11/2002 | Saso | |
| 6,491,592 | B2 | 12/2002 | Cackett et al. | |
| 6,508,978 | B1 | 1/2003 | Deshmukh | |
| 6,527,650 | B2 | 3/2003 | Reyes et al. | |
| 6,565,452 | B2 | 5/2003 | Helmstetter et al. | |
| 6,575,845 | B2 | 6/2003 | Galloway et al. | |

(Continued)

FOREIGN PATENT DOCUMENTS

| | | | | |
|---|---|---|---|---|
| JP | 04180778 | A * | 6/1992 | A63B 53/04 |
| JP | 05337220 | A * | 12/1993 | A63B 53/04 |

(Continued)

*Primary Examiner* — Alvin Hunter
(74) *Attorney, Agent, or Firm* — Rebecca Hanovice; Michael A. Catania; Sonia Lari

(57) ABSTRACT

A golf club head (20) having optimized ball speed robustness is disclosed. The golf club head (20) preferably has one or more channels (100, 110, 120) disposed proximate to a striking face (40), and in some embodiments the one or more channels (100, 110, 120) substantially encircle the striking face (40).

20 Claims, 4 Drawing Sheets

(56) References Cited

U.S. PATENT DOCUMENTS

| | | | | |
|---|---|---|---|---|
| 6,582,323 | B2 | 6/2003 | Soracco et al. | |
| 6,592,466 | B2 | 7/2003 | Helmstetter et al. | |
| 6,602,149 | B1 | 8/2003 | Jacobson | |
| 6,607,452 | B2 | 8/2003 | Helmstetter et al. | |
| 6,612,398 | B1 | 9/2003 | Tokimatsu et al. | |
| 6,663,504 | B2 | 12/2003 | Hocknell et al. | |
| 6,669,578 | B1 | 12/2003 | Evans | |
| 6,739,982 | B2 | 5/2004 | Murphy et al. | |
| 6,758,763 | B2 | 7/2004 | Murphy et al. | |
| 6,783,465 | B2 | 8/2004 | Matsunaga | |
| 6,860,824 | B2 | 3/2005 | Evans | |
| 6,887,165 | B2 * | 5/2005 | Tsurumaki | 473/344 |
| 6,994,637 | B2 | 2/2006 | Murphy et al. | |
| 7,025,692 | B2 | 4/2006 | Erickson et al. | |
| 7,070,517 | B2 | 7/2006 | Cackett et al. | |
| 7,082,665 | B2 * | 8/2006 | Deshmukh et al. | 29/527.6 |
| 7,101,289 | B2 * | 9/2006 | Gibbs et al. | 473/329 |
| 7,112,148 | B2 | 9/2006 | Deshmukh | |
| 7,118,493 | B2 | 10/2006 | Galloway | |
| 7,121,957 | B2 | 10/2006 | Hocknell et al. | |
| 7,125,344 | B2 | 10/2006 | Hocknell et al. | |
| 7,128,661 | B2 | 10/2006 | Soracco et al. | |
| 7,134,971 | B2 * | 11/2006 | Franklin et al. | 473/340 |
| 7,137,907 | B2 | 11/2006 | Gibbs et al. | |
| 7,163,470 | B2 | 1/2007 | Galloway et al. | |
| 7,211,006 | B2 * | 5/2007 | Chang | 473/329 |
| 7,226,366 | B2 | 6/2007 | Galloway | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,294,064 | B2 * | 11/2007 | Tsurumaki et al. | 473/329 |
| 7,314,418 | B2 | 1/2008 | Galloway et al. | |
| 7,320,646 | B2 | 1/2008 | Galloway | |
| 7,387,577 | B2 | 6/2008 | Murphy et al. | |
| 7,396,293 | B2 * | 7/2008 | Soracco | 473/329 |
| 7,396,296 | B2 | 7/2008 | Evans | |
| 7,402,112 | B2 | 7/2008 | Galloway | |
| 7,407,448 | B2 | 8/2008 | Stevens et al. | |
| 7,413,520 | B1 | 8/2008 | Hocknell et al. | |
| 7,431,667 | B2 | 10/2008 | Vincent et al. | |
| 7,438,647 | B1 | 10/2008 | Hocknell | |
| 7,455,598 | B2 | 11/2008 | Williams et al. | |
| 7,476,161 | B2 | 1/2009 | Williams et al. | |
| 7,491,134 | B2 | 2/2009 | Murphy et al. | |
| 7,497,787 | B2 | 3/2009 | Murphy et al. | |
| 7,500,924 | B2 * | 3/2009 | Yokota | 473/332 |
| 7,530,901 | B2 | 5/2009 | Imamoto et al. | |
| 7,549,935 | B2 | 6/2009 | Foster et al. | |
| 7,578,751 | B2 | 8/2009 | Williams et al. | |
| 7,582,024 | B2 * | 9/2009 | Shear | 473/329 |
| 7,717,807 | B2 | 5/2010 | Evans et al. | |
| 7,749,096 | B2 | 7/2010 | Gibbs et al. | |
| 7,749,097 | B2 | 7/2010 | Foster et al. | |
| 7,815,520 | B2 * | 10/2010 | Frame et al. | 473/329 |
| 7,857,711 | B2 * | 12/2010 | Shear | 473/329 |
| D631,119 | S * | 1/2011 | Albertsen et al. | D21/759 |
| 7,867,105 | B2 * | 1/2011 | Moon | 473/314 |
| 7,988,565 | B2 | 8/2011 | Abe | |
| 8,162,775 | B2 | 4/2012 | Tavares et al. | |
| 8,216,087 | B2 | 7/2012 | Breier et al. | |
| 2004/0121852 | A1 * | 6/2004 | Tsurumaki | 473/344 |
| 2004/0192463 | A1 * | 9/2004 | Tsurumaki et al. | 473/329 |
| 2010/0178997 | A1 | 7/2010 | Gibbs | |
| 2011/0021284 | A1 | 1/2011 | Stites et al. | |
| 2011/0151997 | A1 | 6/2011 | Shear | |
| 2011/0218053 | A1 | 9/2011 | Tang et al. | |
| 2011/0244979 | A1 | 10/2011 | Snyder | |
| 2011/0281663 | A1 | 11/2011 | Stites et al. | |
| 2011/0281664 | A1 | 11/2011 | Boyd et al. | |
| 2011/0294599 | A1 | 12/2011 | Albertson et al. | |
| 2012/0034997 | A1 | 2/2012 | Swartz | |
| 2012/0083362 | A1 | 4/2012 | Albertson et al. | |
| 2012/0083363 | A1 | 4/2012 | Albertson et al. | |
| 2012/0142447 | A1 | 6/2012 | Boyd et al. | |
| 2012/0142452 | A1 | 6/2012 | Burnett et al. | |
| 2012/0178548 | A1 | 7/2012 | Tavares et al. | |
| 2012/0196701 | A1 | 8/2012 | Stites et al. | |
| 2012/0196703 | A1 | 8/2012 | Sander | |

FOREIGN PATENT DOCUMENTS

| | | | | | |
|---|---|---|---|---|---|
| JP | 06190088 | A | * | 7/1994 | |
| JP | 10155943 | A | * | 6/1998 | A63B 53/04 |
| JP | 10263118 | A | * | 10/1998 | A63B 53/04 |
| JP | 2002-052099 | | | 2/2002 | |
| JP | 2002052099 | A | * | 2/2002 | A63B 53/04 |
| JP | 2002248183 | A | * | 9/2002 | A63B 53/04 |
| JP | 2003024481 | A | * | 1/2003 | A63B 53/04 |
| JP | 2003210627 | A | * | 7/2003 | A63B 53/04 |
| JP | 2004174224 | A | * | 6/2004 | A63B 53/04 |
| JP | 2004351173 | A | * | 12/2004 | A63B 53/04 |
| JP | 2007136069 | A | * | 6/2007 | |
| JP | 2007275253 | A | * | 10/2007 | |
| JP | 2010029590 | A | * | 2/2010 | |
| JP | 2010279847 | A | * | 12/2010 | |
| JP | 2011024999 | A | * | 2/2011 | |

* cited by examiner

GOLF CLUB HEAD

CROSS REFERENCES TO RELATED APPLICATIONS

The Present application claims priority to U.S. Provisional Patent Application No. 61/311,114, filed on Mar. 5, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a face portion that has optimized compliance and contributes to optimized ball speed robustness.

2. Description of the Related Art

Technical innovation in the material, construction and performance of golf clubs has resulted in a variety of new products. The advent of metals as a structural material has largely replaced natural wood for wood-type golf club heads, and is but one example of this technical innovation resulting in a major change in the golf industry. In conjunction with such major changes are smaller scale refinements to likewise achieve dramatic results in golf club performance. For example, the metals comprising the structural elements of a golf club head have distinct requirements according to location in the golf club head. A sole or bottom section of the golf club head should be capable of withstanding high frictional forces for contacting the ground. A crown or top section should be lightweight to maintain a low center of gravity. A front or face of the golf club head should exhibit high strength and durability to withstand repeated impact with a golf ball. While various metals and composites are known for use in the face, several problems arise from the use of homogeneous and non-homogeneous face materials.

A non-homogeneous face structure typically involves an insert centrally located which requires an exacting fit between two or more distinct elements, but has the advantage of utilizing beneficial material properties in a combination which is not available in each material individually. A homogeneous face structure is simpler to manufacture but is limited to the inherent material properties of one material. The present invention enhances the performance advantages of both homogenous and non-homogeneous face structures by implementing a simple structural change.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. Complete descriptions of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e, which measures club face COR. This USGA test procedure, as well as procedures like it, may be used to measure club face COR.

BRIEF SUMMARY OF THE INVENTION

The present invention is generally directed to a golf club head comprising channels proximate to the striking face of the club which serve to increase ball speed robustness.

One aspect of the present invention is a golf club head comprising a body comprising a crown and a sole, and a face portion attached to the body, the face portion comprising a striking face and a rear section extending laterally rearwardly from the striking face, wherein the rear section comprises a sole side, a crown side, a heel side, and a toe side, wherein the heel side comprises a first channel and the toe side comprises a second channel, wherein the first channel extends along the heel side proximate to and parallel with the striking face, and wherein the second channel extends along the toe side proximate to and parallel with the striking face.

In a further embodiment, each of the first and second channels is approximately 0.06 to 0.25 inch deep, 0.15 to 0.5 inch wide, and 0.5 to 2.5 inches long. The first and second channels may be located in substantially mirror imaged positions with respect to a vertical plane bisecting said striking face, and may extend from the sole side to the crown side. In another embodiment, the first channel may extend less than or equal to half of a length of the heel side, wherein the length is measured from the crown side to the sole side along the heel side. In yet another embodiment, wherein the second channel may extend less than or equal to half of a length of the toe side, wherein the length is measured from the crown side to the sole side along the toe side.

Another aspect of the present invention is golf club head comprising a body having a crown, a sole, a heel end, a toe end, and an opening, a face portion attached to the body at the opening, the face portion comprising a striking face for contacting a ball, wherein the heel side comprises a first channel that extends along the heel end proximate to and parallel with the striking face, and wherein the toe side comprises a second channel that extends along the toe end proximate to and parallel with the striking face. Each of the first and second channels may be approximately 0.06 to 0.25 inch deep, 0.15 to 0.5 inch wide, and 0.5 to 2.5 inches long.

In a further embodiment, the striking face is an insert. In yet another further embodiment, the first and second channels may be located in substantially mirror imaged positions with respect to a vertical plane bisecting said striking face. The first and second channels each may extend from the sole to the crown, and may extend less than or equal to half of a length of the heel end and/or a toe end, respectively, wherein the length is measured from the crown to the sole along the heel and/or toe end.

Yet another aspect of the present invention is a golf club head comprising a body having a crown, a sole, a heel end, a toe end, and an opening and a face portion attached to the body at the opening, the face portion comprising a striking face for contacting a ball, wherein a plurality of channels are defined in the crown, sole, heel end, and toe end proximate the striking face and wherein the plurality of channels substantially encircle the striking face. Each of the channels may be substantially rectangular in shape, having two longer sides and two shorter sides, wherein at least one of the longer sides of each channel is disposed on the body parallel with the striking face. Each of the channels may be approximately 0.090 to 0.250 inch deep, 0.120 to 0.375 inch wide, and 0.400 to 1.500 inches long, and they may be spaced 0.06 to 0.50 inch apart from one another on the body.

In a further embodiment, the plurality of channels comprises six to thirty channels. In yet another further embodiment, the plurality of channels is composed of two continuous channels, each of which substantially encircles the striking face, and each of which is 0.090 to 0.250 inch deep and 0.120 to 0.375 inch wide.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is generally directed to a golf club head that has an improved structure to reduce energy loss during impact of a golf club head with a golf ball and to increase ball speed robustness. A preferred embodiment of the golf club head of the present invention is illustrated in FIGS. 1, 1A, 2, and 3. Alternative embodiments of the present invention are illustrated in FIGS. 4, 5, 5A, 5B, 5C, 6, and 6A. Although four embodiments are illustrated, those skilled in the pertinent art will recognize from this disclosure that other embodiments of the golf club head of the present invention are possible without departing from the scope and spirit of the present invention.

Figure 1:
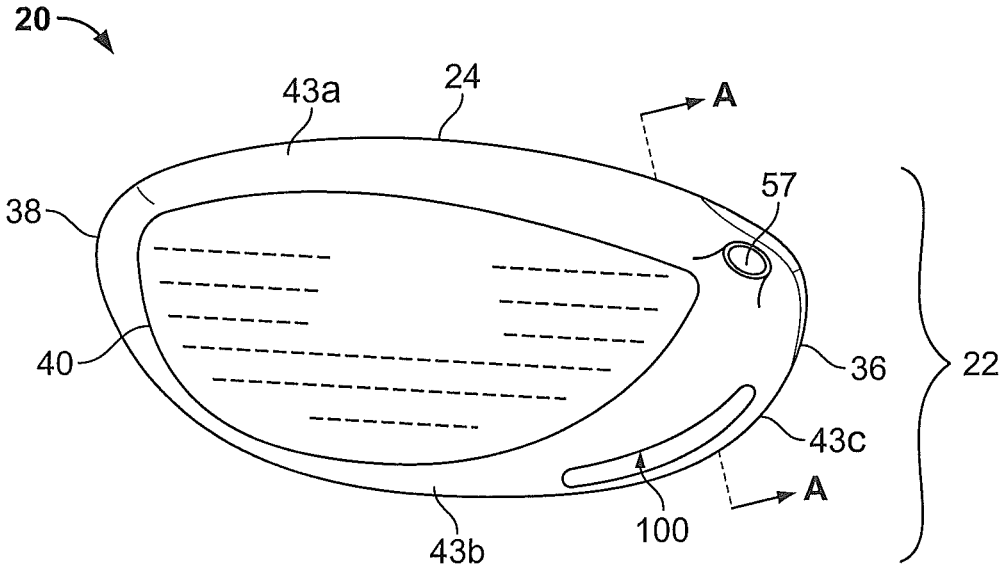
FIG. 1 is a front view of a golf club head according to a first embodiment of the present invention.
Figure 1A:
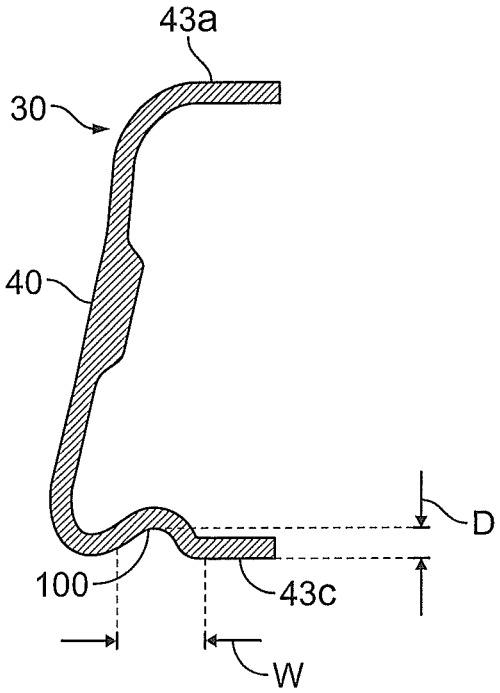
FIG. 1A is a cross-sectional view taken along the line A-A of FIG. 1.
Figure 2:
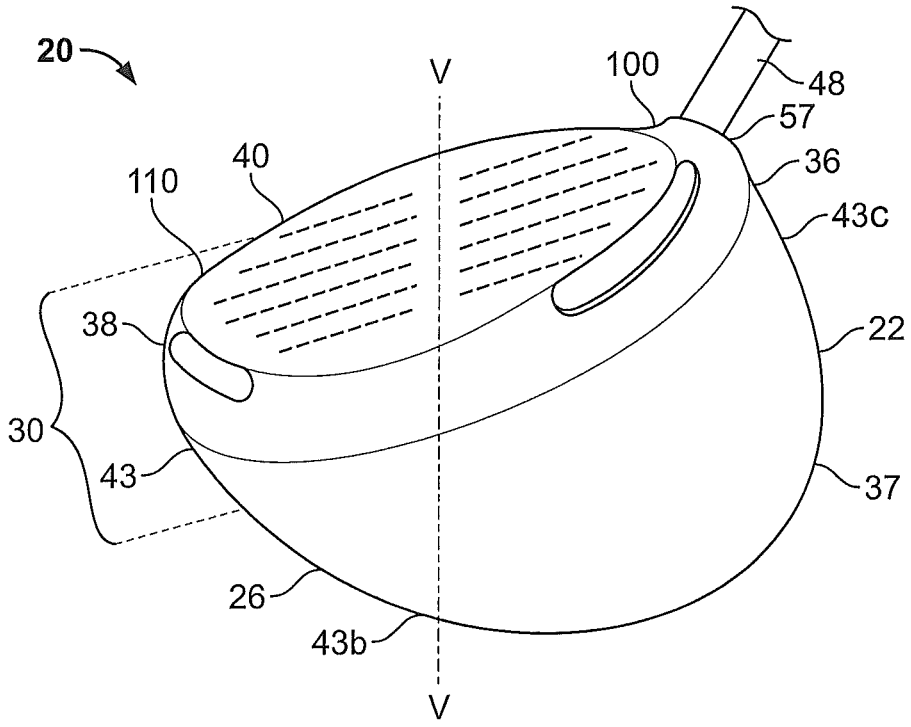
FIG. 2 is an alternative front view of the golf club head of FIG. 1.
Figure 3:
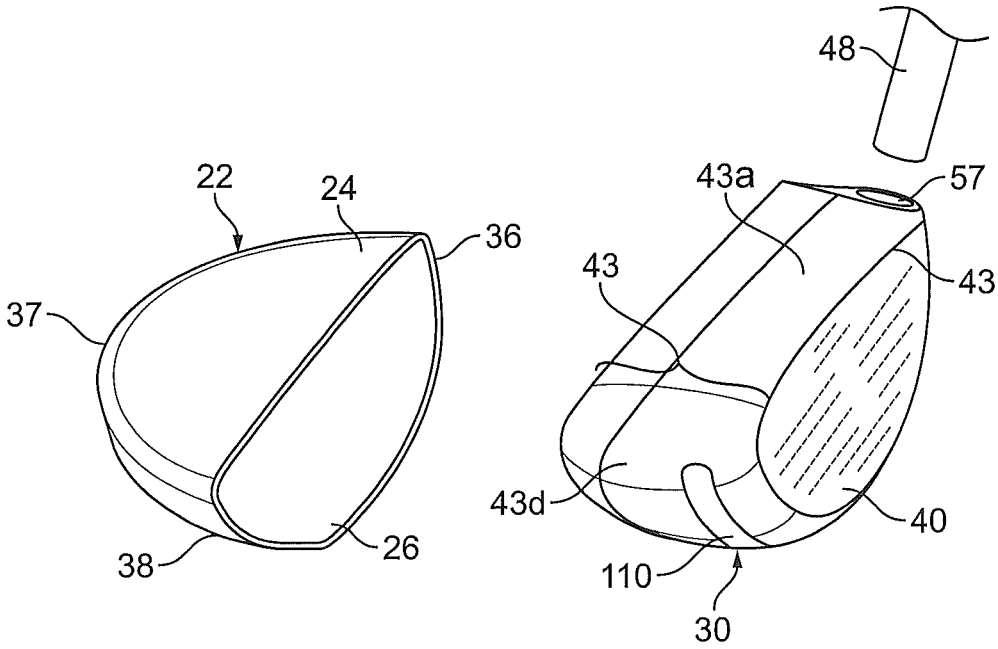
FIG. 3 is an exploded top-view perspective of the first embodiment of the present invention.

As shown in FIGS. 1, 1A, 2, and 3, a preferred embodiment of the golf club head 20 comprises hollow body 22 having a crown 24, a sole 26, a heel end 36, a toe end 38, a hosel 57 to which a shaft 48 may be attached, and a back portion 37. As shown in FIG. 1A, attached to the body 22 is a front portion 30 comprising a striking face 40 and a rear section 43 that extends laterally rearwardly from the striking face 40. As shown in FIGS. 1A, 2 and 3, the rear section 43 has a crown side 43*a*, a sole side 43*b*, a heel side 43*c*, and a toe side 43*d*. Thus, the rear section 43 encircles the striking face 40 a full 360 degrees. However, those skilled in the pertinent art will recognize that the rear section 43 may only encompass a partial section of the striking face 40, such as 270 degrees or 180 degrees, and may also be discontinuous.

In the preferred embodiment, shown in FIGS. 1, 1A, 2, and 3 a first channel 100 is defined in the heel side 43*c* of the rear section 43 and a second channel 110 is defined in the toe side 43*d* of the rear section 43, as shown in FIGS. 2 and 3. As shown in FIGS. 1, 2, and 3, the first channel 100 and second channel 110 extend along the heel side 43*c* and toe side 43*d* of the rear section 43 respectively, proximate to and parallel with the contour of the striking face 40. As shown in FIG. 1A, a cross sectional view of the front portion 30 along lines A-A, the first channel 100 has a discernable depth.

In the preferred embodiment, the first channel 100 and second channel 110 are both narrow, shallow indentations located in the rear section 43, each having approximate measurements of 0.060 to 0.250 inch deep ("D"), 0.15 to 0.50 inch wide ("W"), and 0.50 to 2.5 inches long. In a most preferred embodiment, the channels are 0.15 inch deep, 0.32 inch wide, and 1.5 inch long. The proportions of the first channel 100 and second channel 110 may vary, however, and particularly the lengths. For example, the first channel 100 and second channel 110 may extend from the sole side 43*b* to the crown side 43*a* of the rear section 43, or may extend only halfway, or less than halfway, of the length between the sole side 43*b* and the crown side 43*a*.

In further embodiments, the first channel 100 may be a different length than the second channel 110. For example, the first channel 100 may extend less than half of the length of the heel side 43*c*, as measured from the sole side 43*b* to the crown side 43*a*, and the second channel 110 may extend more than half of the length of the toe side 43*d*, as measured from the sole side 43*b* to the crown side 43*a*.

The locations of the first channel 100 and second channel 110 may also vary. For example, as shown in FIG. 2, the first channel 100 and second channel 110 are located closer to the sole side 43*b* of the rear section 43 than the crown side 43*a*. In another embodiment, the first channel 100 and the second channel 110 may be located closer to the crown side 43*a* than the sole side 43*b*. As shown in FIG. 2, the first channel 100 and second channel 110 may also be located in substantially mirror imaged positions with respect to a vertical plane, the line "V", bisecting the striking face 40. In an alternative embodiment, the golf club head 20 comprises only the first channel 100 or the second channel 110 as described herein.

Figure 4:
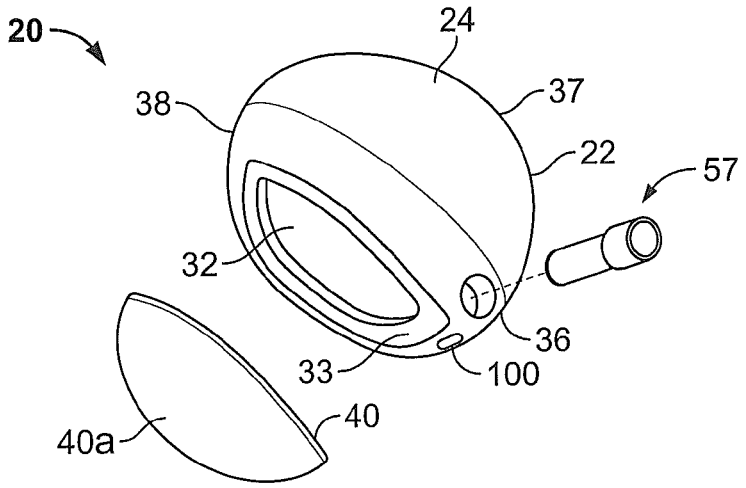
FIG. 4 is an exploded front-view perspective of a second embodiment of the present invention.

A second embodiment of the golf club head 20 of the invention is shown in FIG. 4. In this embodiment, the golf club head 20 has a body 22 comprising a crown 24, a sole 26 (not shown), a back portion 37, a heel end 36, a toe end 38, a hosel 57 to which a shaft 48 (not shown) may be attached, and a recessed portion 33 which, together with the crown 24, sole, 26, heel end, 36, and toe end 38, defines an opening 32 for receiving a face portion. In this embodiment, the face portion is a striking face 40 insert that is attached to the body 22 over the opening 32 defined by the recessed portion 33 and the other elements of the body 22.

In this second embodiment, a first channel 100 is defined in the heel end 36 and a second channel 110 (not shown) is defined in the toe end 38, as described above in relation to the first embodiment of the invention. The first channel 100 and second channel 110 extend along the heel end 36 and toe end 38, respectively, proximate to and parallel with the striking face insert 40. The first channel 100 and second channel 110 are both narrow, shallow indentations in the heel end 36 and toe end 38, each having approximate measurements of 0.060 to 0.250 inch deep, 0.15 to 0.50 inch wide, and 0.50 to 2.5 inches long. In a most preferred embodiment, the channels are 0.15 inch deep, 0.32 inch wide, and 1.5 inch long.

The proportions of the first channel 100 and second channel 110 may vary, however, and particularly the lengths. For example, the first channel 100 and second channel 110 may extend from the sole 26 to the crown 24, or may extend only halfway, or less than halfway, of the length between the sole 26 and the crown 24. In further embodiments, the first channel 100 may be a different length than the second channel 110. For example, the first channel 100 may extend less than half of the length of the heel end 36, as measured from the sole 26 to the crown 24, and the second channel 110 may extend more than half of the length of the toe end 38, as measured from the sole 26 to the crown 24.

The locations of the first channel 100 and second channel 110 also may vary. For example, as described above in reference to the first embodiment of the invention, the first channel 100 and second channel 110 are located closer to the sole 26 than the crown 24. In another embodiment, the first channel 100 and the second channel 110 may be located closer to the crown 24 than the sole 26. The first channel 100 and second channel 110 may also be located in substantially mirror imaged positions with respect to a vertical plane bisecting the striking face insert 40. In an alternative embodiment, the golf club head 20 may comprise only the first channel 100 or the second channel 110 as described herein.

Figure 5:
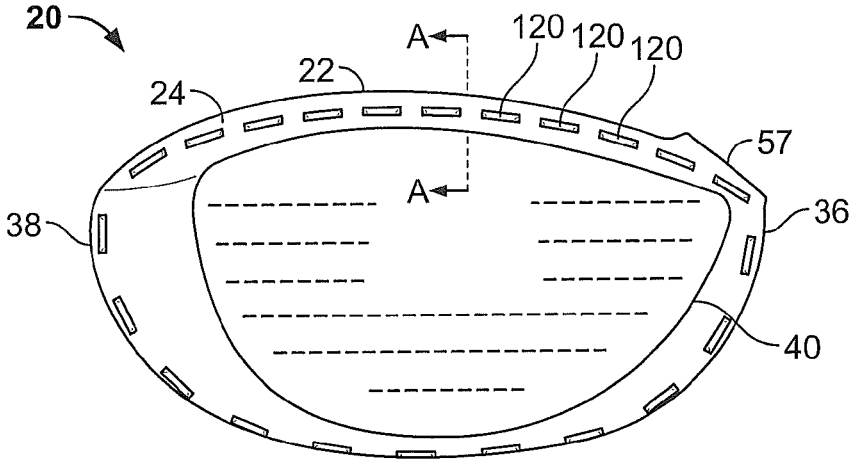
FIG. 5 is a front view of a golf club head according to a third embodiment of the present invention.

A third embodiment of the golf club head 20 of the invention is shown in FIG. 5. In this embodiment, the golf club head 20 has a body 22 comprising a crown 24, a sole 26 (not shown), a back portion 37 (not shown), a heel end 36, a toe end 38, a hosel 57 to which a shaft 48 (not shown) may be attached, and an opening 32 (not shown) defined by the crown 24, sole, 26, heel end, 36, and toe end 38, for receiving a face portion. In this embodiment, the face portion is a striking face insert 40 attached to the body 22 over the opening 32 defined by the other elements of the body 22. The third embodiment further comprises a plurality of channels 120 defined in the crown 24, sole 26, heel end 36, and toe end 38, such that the plurality of channels 120 substantially encircle the striking face insert 40. In an alternative embodiment, the club head comprises a face component with a striking face 40 and a rear section 43 portion as shown in FIGS. 1, 1A, 2, 3, wherein the plurality of channels are disposed in the rear section 43.

Figure 5A:
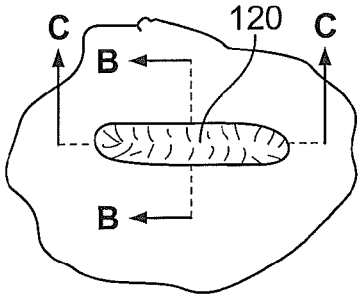
FIG. 5A is a top view of the region circled in FIG. 5.
Figure 5B:
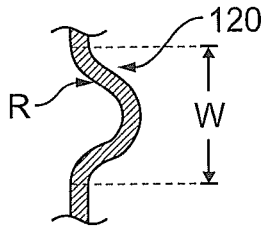
FIG. 5B is a cross-sectional view along the line B-B in FIG. 5A.
Figure 5C:
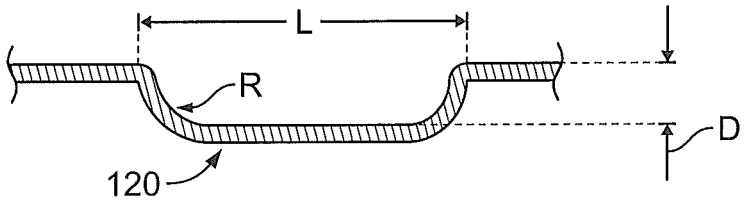
FIG. 5C is a cross-sectional view along the line C-C in FIG. 5A.

As shown in FIG. 5, each of the channels 120 is generally rectangular in shape, having two shorter sides and two longer sides. In the embodiment shown in FIG. 5, the longer sides of each of the channels 120 are disposed on the body 22 parallel to the striking face insert 40. In an alternative embodiment, the channels 120 may be disposed on the body 22 such that their shorter sides are parallel to the striking face insert 40. Those skilled in the pertinent art will realize that the proportions of the channels 120 may vary, but in the preferred embodiment each channel 120, as shown in FIGS. 5A, 5B, and 5C, is approximately 0.090 to 0.250 inch deep ("D"), 0.12 to 0.375 inch wide ("W"), and 0.40 to 1.5 inches long ("L"), with a radius of curvature R. In a most preferred embodiment, each channel is 0.16 inch deep, 0.25 inch wide, and 0.5 inch long.

The channels 120 preferably are spaced 0.06 to 0.50 inch apart from one another on the body 22, such that the edge of one channel 120 is between 0.06 and 0.50 inch away from the edge of the next channel 120, and most preferably are 0.25 inch apart from each other. In the preferred embodiment, there are between six and twelve channels 120 on each of the crown 24 and the sole 26, with a total of approximately thirty channels 120 encircling the striking face.

Figure 6:
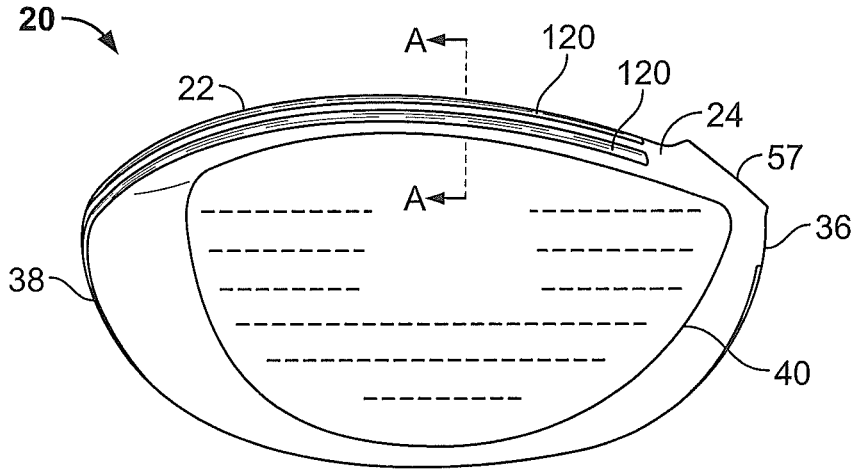
FIG. 6 is a front view of a golf club head according to a fourth embodiment of the present invention.
Figure 6A:
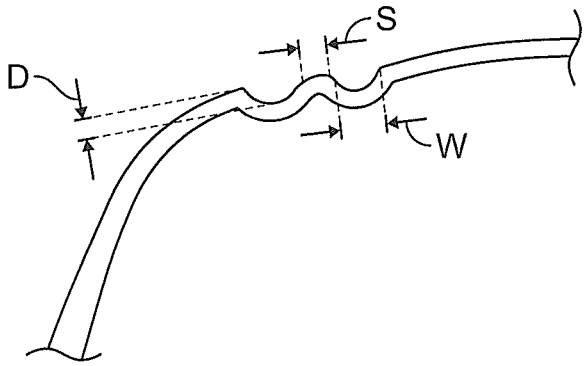
FIG. 6A is a cross-sectional view along the line A-A in FIG. 6.

A fourth embodiment of the golf club head 20 of the invention is shown in FIG. 6. In this embodiment, the golf club head 20 has a body 22 comprising a crown 24, a sole 26 (not shown), a back portion 37 (not shown), a heel end 36, a toe end 38, a hosel 57 to which a shaft 48 (not shown) may be attached, and an opening 32 (not shown) defined by the crown 24, sole, 26, heel end, 36, and toe end 38, for receiving a striking face insert 40. The striking face insert 40 is attached to the body 22 over the opening 32 defined by the other elements of the body 22. This embodiment further comprises two continuous channels 120 defined on the crown 24, sole 26, heel end 36, and toe end 38. In this embodiment, the two channels 120 extend proximate to the striking face insert 40 and substantially encircle the striking face insert. The channels are approximately 0.090 to 0.250 inch deep ("D"), 0.12 to 0.375 inch wide ("W"), and are spaced apart from one another by 0.06 to 0.50 inch ("S"). In a most preferred embodiment, the channels are each 0.16 inch deep, 0.25 inch wide, and are spaced 0.15 inch apart from one another. In an alternative embodiment, the club head comprises a face component with a striking face 40 and a rear section 43 portion as shown in FIGS. 1, 1A, 2, 3, wherein the two channels 120 are disposed in the rear section 43.

The body 22 of the present invention is preferably composed of a non-metal material, more preferably a composite material, and most preferably the composite material described in U.S. patent application Ser. No. 12/939,477, the disclosure of which is incorporated in its entirety herein. In another embodiment, the composite material instead is a continuous fiber pre-preg material (including thermosetting materials or thermoplastic materials for the resin). Other materials that can be used to form the body 22 include thermosetting materials or thermoplastic materials such as injectable plastics. The body 22 is preferably manufactured through bladder-molding, resin transfer molding, resin infusion, injection molding, compression molding, or a similar process.

In alternative embodiments, the body 22 is composed of a lightweight metallic material, such as titanium, titanium alloys, magnesium alloys, aluminum alloys, magnesium, aluminum or other low density metals. In another embodiment, the body 22 comprises a metal sole 26 and a composite crown 24. In yet other embodiments, the body 22 has a multi-material composition such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head 20, when designed as a driver, preferably has a volume from 200 cubic centimeters to 600 cubic centimeters, more preferably from 300 cubic centimeters to 500 cubic centimeters, and most preferably from 400 cubic centimeters to 460 cubic centimeters. The volume of the golf club head 20 also varies between fairway woods (preferably ranging from 3-woods to eleven woods) with smaller volumes than drivers. The golf club head 20 preferably has a mass of no more than 225 grams, and most preferably a mass of 180 to 215 grams.

In the embodiments of the invention, the striking face/striking face insert 40 is preferably composed of a formed metal material. However, the striking face/striking face insert 40 may also be composed of a machined metal material, a forged metal material, a cast metal material or the like. The striking face/striking face insert 40 preferably is composed of a titanium or steel material. Titanium materials suitable for the striking face/striking face insert 40 include pure titanium and titanium alloys. Other metals for the striking face/striking face insert 40 include high strength steel alloy metals and amorphous metals. As shown in FIGS. 1, 2, 5, and 6, the exterior surface 40*a* of the striking face insert 40 typically has a plurality of scorelines thereon.

In the preferred embodiment, the striking face/striking face insert 40 has a variable thickness ranging from 0.065 to 0.170 inch, and comprises one or more of the thickness patterns described in U.S. Pat. Nos. 5,830,084, 6,354,962, 6,368,234, 6,398,666, 6,435,977, 6,491,592, 7,137,907, 7,101,289, and 7,258,626, the disclosures of each of which is hereby incorporated by reference in its entirety herein, and U.S. patent application Ser. No. 12/711,435, the disclosure of which is hereby incorporated by reference in its entirety herein. In another embodiment, the striking face/striking face insert 40 has uniform thickness in the range from 0.040 inch to 0.250 inch, and more preferably in the range from 0.065 inch to 0.170 inch.

The striking face/striking face insert 40 is preferably co-molded with the body 22 or adhered to the opening 32 subsequent to fabrication of the body 22. In another attachment process, the body 22 is first bladder molded and then the striking face insert 40 is bonded to the recessed portion 33 of the front portion 30 using an adhesive. The adhesive is placed on the exterior surface of the recessed portion 33. Such adhesives include thermosetting adhesives in a liquid or a film medium. In yet another attachment process, the body 22 is first bladder molded and then the striking face/striking face insert 40 is mechanically secured to the body 22. Those skilled in the pertinent art will recognize that other methods for attachment of the striking face insert 40 to the body 22 may be composed without departing from the scope and spirit of the present invention.

The proportions of the golf club head 20 of the present invention may vary, though preferably the depth of the golf club head 20 from the striking face 40 to the farthest point on the back portion 37 ranges from 3.0 inches to 5 inches, and is most preferably 3.74 inches. The height of the golf club head 20, as measured while in address position from the sole 26 to the crown 24, preferably ranges from 2.0 inches to 3.5 inches, and is most preferably 2.62 inches. The width of the golf club head 20 from the toe end 38 to the heel end 36 preferably ranges from 4.0 inches to 5.5 inches, and more preferably 4.57 inches. The height of the striking face 40, preferably ranges from 1.8 inches to 2.5 inches, and is most preferably 2.08 inches. The width of the striking face 40 from the toe end to the heel end preferably ranges from 3.0 inches to 5.0 inches, and more preferably 3.52 inches.

Another aspect of the golf club head 20 of the present invention is directed to a golf club head 20 that has a high coefficient of restitution for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 20 preferably has a coefficient of restitution ranging from 0.80 to 0.94, as measured under conventional test conditions, more preferably ranging from 0.82 to 0.89, and most preferably 0.83.

As defined in *Golf Club Design, Fitting, Alteration & Repair*, 4th Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 of the present invention is preferably greater than 3000 g-cm$^2$, and more preferably greater than 3500 g-cm$^2$. The moment of inertia, Iyy, about the Y axis for the golf club head 20 of the present invention is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 20 of the present invention is preferably in the range from 1500 g-cm$^2$ to 3800 g-cm$^2$, more preferably from 1600 g-cm$^2$ to 3100 g-cm$^2$.

The golf club head 20 of the present invention has moments of inertia Ixx, Iyy and Izz and a center of gravity location that are optimized to improve the performance of the club head. An improved robustness efficiency parameter, also referred to herein as "REP," for greater inertial properties for both back spin and side spin optimization for impact variation on the club face is captured by the following equation:

$$REP = \left[\frac{I_{xx}}{(I_{yy} + 1.7(I_{zz}))}\right] * \frac{Dcg}{Rball}$$

wherein Dcg is the distance from the face impact to the club head center of gravity. For convenience, the distance Dcg is taken as the distance from the center of the striking face to the center of mass of the club head. Rball is simply the radius of the golf ball, which is set by the rules of golf. Ixx is the inertia about a fore/aft axis through the center of gravity. Izz is the club head inertia about a vertical axis through the center of gravity. Iyy is the club head inertia about an axis in the heel to toe direction through the center of gravity. In the parameterized relationship, the Izz inertia term is weighted by a factor of 1.7. This factor exists because the hit distribution variation is greater in the near horizontal direction than in the vertical direction. The REP equation optimizes the moments of inertia Izz and Iyy and the center of gravity relative to the moment of inertia Ixx.

The golf club heads of the present invention preferably have a center of gravity located less than 1.7 inches from an exterior surface of the striking plate, and a robustness efficiency parameter of less than 0.41.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body having a crown, a sole, a heel end, a toe end, and an opening, the body composed of a non-metal material; and a face portion attached to the body at the opening, the face portion composed of a metal material and comprising a striking face for contacting a ball;

wherein a single row comprising at least six discrete, collinear channels is defined in each of the crown and the sole proximate the striking face;

wherein a single row comprising a plurality of discrete, collinear channels is defined in each of the heel end and the toe end proximate the striking face;

wherein the channels are spaced 0.06 to 0.50 inch apart from one another on the body, and wherein the collinear channels on each of the crown, sole, heel end, and toe end substantially encircle the striking face.

2. The golf club head of claim 1, wherein each of the channels is substantially rectangular in shape, having two longer sides and two shorter sides, and wherein at least one of the longer sides of each channel is disposed on the body parallel with the striking face.

3. The golf club head of claim 1, wherein each of the channels is approximately 0.090 to 0.250 inch deep, 0.120 to 0.375 inch wide, and 0.400 to 1.500 inches long.

4. The golf club head of claim 1, wherein the non-metal material is a composite material.

5. The golf club head of claim 1, wherein the non-metal material is a plastic material.

6. The golf club head of claim 1, wherein the metal material is a titanium alloy.

7. The golf club head of claim 1, wherein the metal material is a steel material.

8. The golf club head of claim 1, wherein the face portion is formed.

9. The golf club head of claim 1, wherein the face portion is forged.

10. The golf club head of claim 1, wherein the striking face comprises variable thickness.

11. The golf club head of claim 10, wherein the thickness of the striking face is no less than 0.065 inch and no more than 0.170 inch.

12. The golf club head of claim 1, wherein the face portion is attached to the body with an adhesive.

13. The golf club head of claim 1, wherein the face portion is a face insert.

14. The golf club head of claim 1, wherein the golf club head is a driver-type head and has a volume of no less than 300 cubic centimeters and no more than 500 cubic centimeters.

15. The golf club head of claim 14, wherein the golf club head has a volume of no less than 400 cubic centimeters and no more than 460 cubic centimeters.

16. The golf club head of claim 1, wherein the golf club head has a mass of no more than 225 grams.

17. The golf club head of claim 16, wherein the golf club head has a mass of no less than 180 grams and no more than 215 grams.

18. The golf club head of claim 1, wherein the golf club head has an Izz greater than 3000 g-cm$^2$, an Iyy greater than 2000 g-cm$^2$, and an Ixx greater than 1500 g-cm$^2$.

19. The golf club head of claim 18, wherein the golf club head has an Izz greater than 3500 g-cm$^2$, an Iyy in the range of 2000 g-cm$^2$ to 4000 g-cm$^2$, and an Ixx of in the range of 1500 g-cm$^2$ to 3800 g-cm$^2$.

20. The golf club head of claim 1, wherein the golf club head has a coefficient of restitution ranging from 0.82 to 0.89.

* * * * *